US006385806B1

(12) United States Patent
Katakura et al.

(10) Patent No.: US 6,385,806 B1
(45) Date of Patent: May 14, 2002

(54) SURFACE TREATING DEVICE

(75) Inventors: Takaaki Katakura, Yokohama; Sousaburou Ohara; Akira Miyagi, both of Tokyo, all of (JP)

(73) Assignee: Taiho Industries Co. Ltd., Tokyo (JP)

( * ) Notice: Subject to any disclaimer, the term of this patent is extended or adjusted under 35 U.S.C. 154(b) by 12 days.

(21) Appl. No.: 09/619,578

(22) Filed: Jul. 19, 2000

(30) Foreign Application Priority Data

Jan. 26, 2000 (JP) ..... 2000-016685

(51) Int. Cl.[7] ..... A47L 13/30

(52) U.S. Cl. ..... 15/104.94; 15/229.11; 15/244.3; 401/196

(58) Field of Search ..... 15/104.94, 210.1, 15/220.1, 229.11, 244.1, 244.3; 401/6, 196, 202, 261, 262

(56) References Cited

U.S. PATENT DOCUMENTS 1,933,893 A * 11/1933 Clark
2,281,105 A * 4/1942 Marti et al.
2,873,464 A * 2/1959 Rosenthal
3,133,308 A * 5/1964 Claypool
5,567,073 A * 10/1996 de Laforcade et al.
5,603,138 A * 2/1997 Bonis
6,199,240 B1 * 3/2001 You

FOREIGN PATENT DOCUMENTS

DE 3708051 * 9/1987

* cited by examiner

*Primary Examiner*—Terrence R. Till
(74) *Attorney, Agent, or Firm*—Oblon, Spivak, McClelland, Maier & Neustadt, P.C.

(57) ABSTRACT

A surface treating device includes a material that constitutes a treating portion of a continuously foamed body coated with a fibrous film, a holder that has a base for supporting the treating portion thereon and an annular groove provided in an inside peripheral surface thereof with an engaging structure, and an annular engaging member that has a distal end forcibly fitting an end of the treating portion into the annular groove of the holder to support the treating portion on and fix it integrally to the base.

5 Claims, 5 Drawing Sheets

SURFACE TREATING DEVICE

BACKGROUND OF THE INVENTION

1. Field of the Invention

The present invention relates to a surface treating device formed by assembling a small number of members having simple configuration, that can be used as a lustering-agent applicator used for lustering car bodies or tires, furniture, etc. as well as a cleaner, an eraser for a blackboard or other such device.

2. Description of the Prior Art

A great number of brushes or applicators having a grip to be held by a user have heretofore been proposed.

Typical of the proposed brushes are represented by toothbrushes, clothesbrushes, etc. having a treating portion constituted of numerous bristle members. Generally, the treating portion has a relatively small area or is rod-shaped. The major structural feature of the treating portion is that the proximal ends of the bristle members are totally adhered and fixed to a base by means of an adhesive agent.

The proposed applicators have a treating portion constituted of various kinds of materials. Materials capable of retaining a liquid composition therein include a continuously foamed body, such as sponge, and a continuously foamed body coated with cloth, felt or the like. The treating portion generally has a relatively large area. The major structural feature of the treating portion constituted of sponge, for example, is that the back surface of the sponge is adhered and fixed to a base by means of an adhesive agent. When the treating portion is constituted of sponge coated with cloth, for example, the side edges of the cloth are fixed to the peripheral edge of a base by means of an adhesive agent or metal fittings. So-configured applicators are disclosed in JP-A 54-177764, JP-A 54-177766, JP-B 57-46939, JP-B 59-9742, JP-B 60-2046 and JP-B 559923.

However, since the conventional brushes or applicators are fabricated using an adhesive agent, they cannot be used until the adhesive agent sets. In addition, the adhesive agent contains an organic solvent. For these reasons, the productivity thereof is not good. To be specific, the material of the treating portion easily falls out before the adhesive agent sets. Therefore, a step of setting the adhesive agent is required. In addition, the adhesive agent contains an organic solvent that is flammable and harmful to the human body. Therefore, it is necessary to install an exhausting unit and pay strict attention to fire prevention.

Some structures using no adhesive agent, such as an eraser for a blackboard, also have heretofore been proposed. In this case, a strap of metal has to be attached and fixed to the peripheral edge of a base by striking metal fittings such as rivets. Since the assembling work requires special treatments, as described above, the productivity of the devices is not good and the production cost is high.

On the other hand, the work of lustering car bodies is to coat a thin film of a water-repellent treating agent, such as liquid or semisolid wax onto the car body surface. A car owner has to assemble a set of materials including an applicator such as a spongy member, a water-repellent treating agent, a container for the treating agent, a cloth member for thinly applying and wiping off the treating agent and disposable gloves for carrying out this work. This set is bulky and takes up a large space. If always kept in a car trunk, it is likely to be a nuisance, especially if not frequently used.

In view of the above, the present invention has been accomplished and one object thereof is to provide a surface treating device that can be easily fabricated with high productivity without requiring the use of an adhesive agent or the work of welding or other such attaching treatment.

Another object of the present invention is to provide a surface treating device advantageously usable for the work of lustering car bodies without requiring the use of an applicator, wax, a cloth member, etc.

SUMMARY OF THE INVENTION

To attain the above objects, the present invention provides a surface treating device comprising a material that constitutes a treating portion of a continuously foamed body coated with a fibrous film, a holder that has a base for supporting the treating portion thereon and an annular groove provided in an inside peripheral surface thereof with an engaging structure, and an annular engaging member that has a distal end forcibly fitting an end of the treating portion into the annular groove of the holder to support the treating portion on and fix it integrally to the base.

The continuously foamed body may be impregnated with wax, detergent or like agent.

The holder may be provided with a hollow cylindrical grip portion having in an open end face thereof a ring groove and with a base member having on a peripheral edge thereof a downwardly overhanging portion that constitute an engaging structure fitted on the open end face of the grip portion.

The surface treating device may be provided further with a cover member having a bulged portion for covering the treating portion.

As described above, the surface treating device according to the present invention comprises a material constituting a treating portion, a holder and an annular engaging member. These component members can be assembled with ease into a surface treating device, without use of adhesive agent or other such agent, by a simple operation of forcing the treating portion into an annular groove of the holder and fitting the annular engaging member in the annular groove. Thus, the present invention can provide a surface treating device that can be produced with high efficiency and used with high safety.

The surface treating device of the present invention having a treating portion impregnated with wax can be used directly for the work of lustering car bodies without requiring separate preparation of an applicator, wax and a cloth member. Thus, the present invention can provide a surface treating device that can be put to very advantageous and practical use.

The above and other objects, characteristic features and advantages of the present invention will become apparent from the detailed description to be made herein below with reference to the accompanying drawings.

DESCRIPTION OF THE PREFERRED EMBODIMENTS

Figure 1:
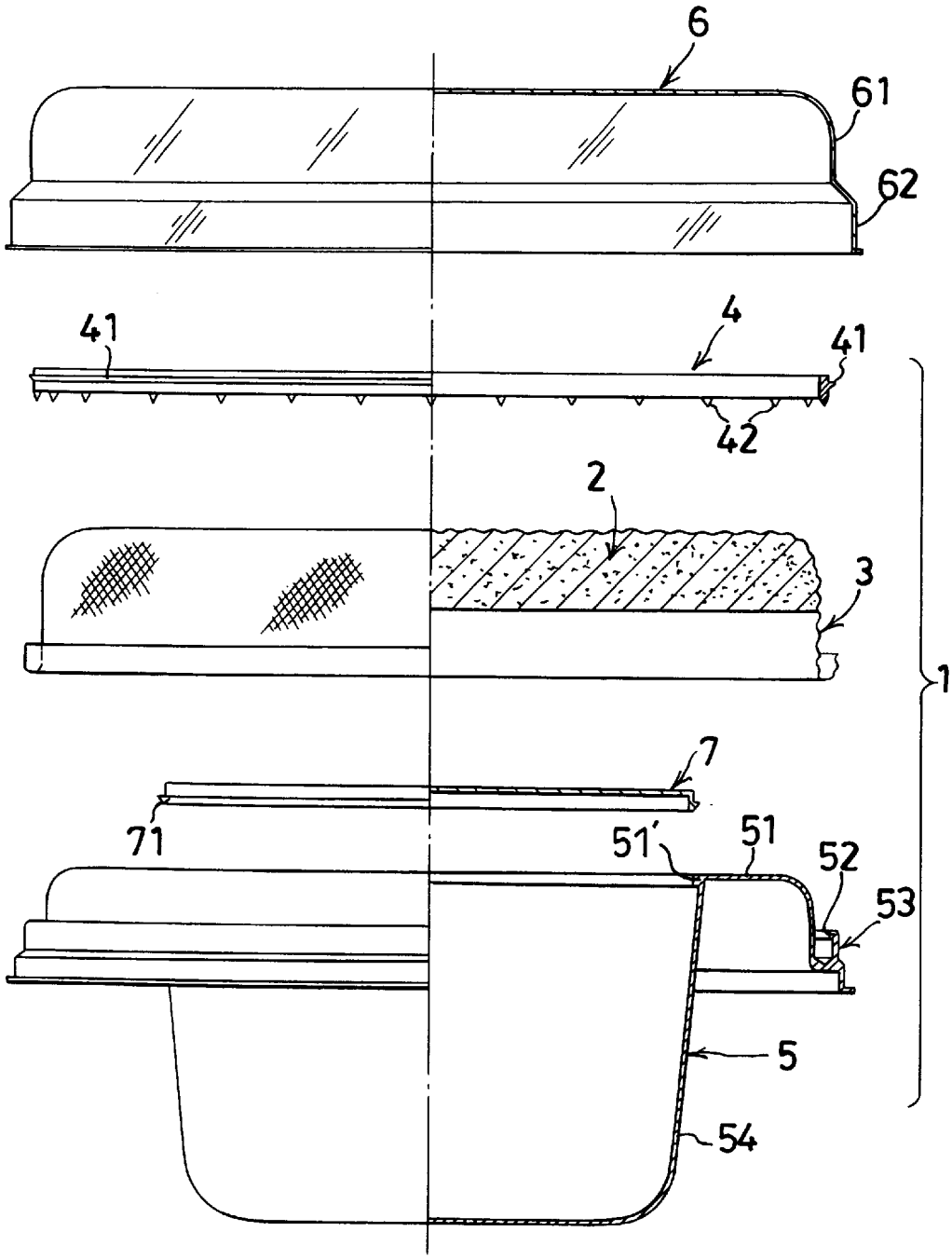
FIG. 1 is an exploded front view showing a first embodiment of the surface treating device according to the present invention, with the right half thereof sectioned.
Figure 2:
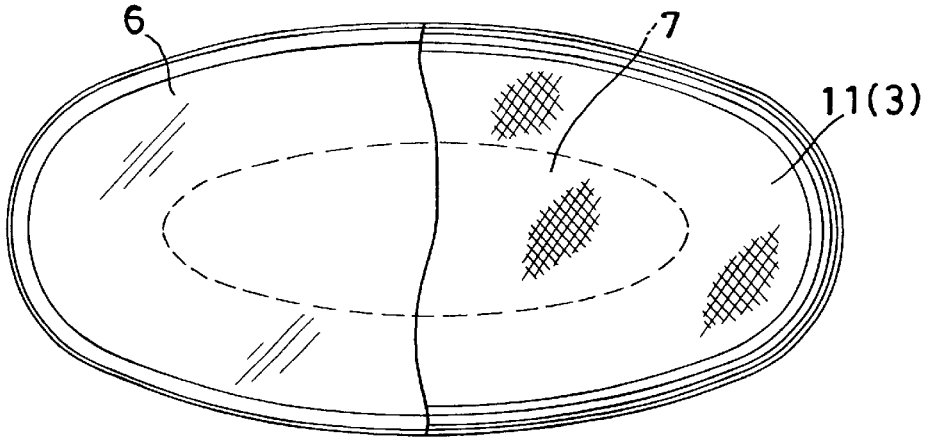
FIG. 2 is a partially cutaway plan view showing the surface treating device of FIG. 1.
Figure 3:
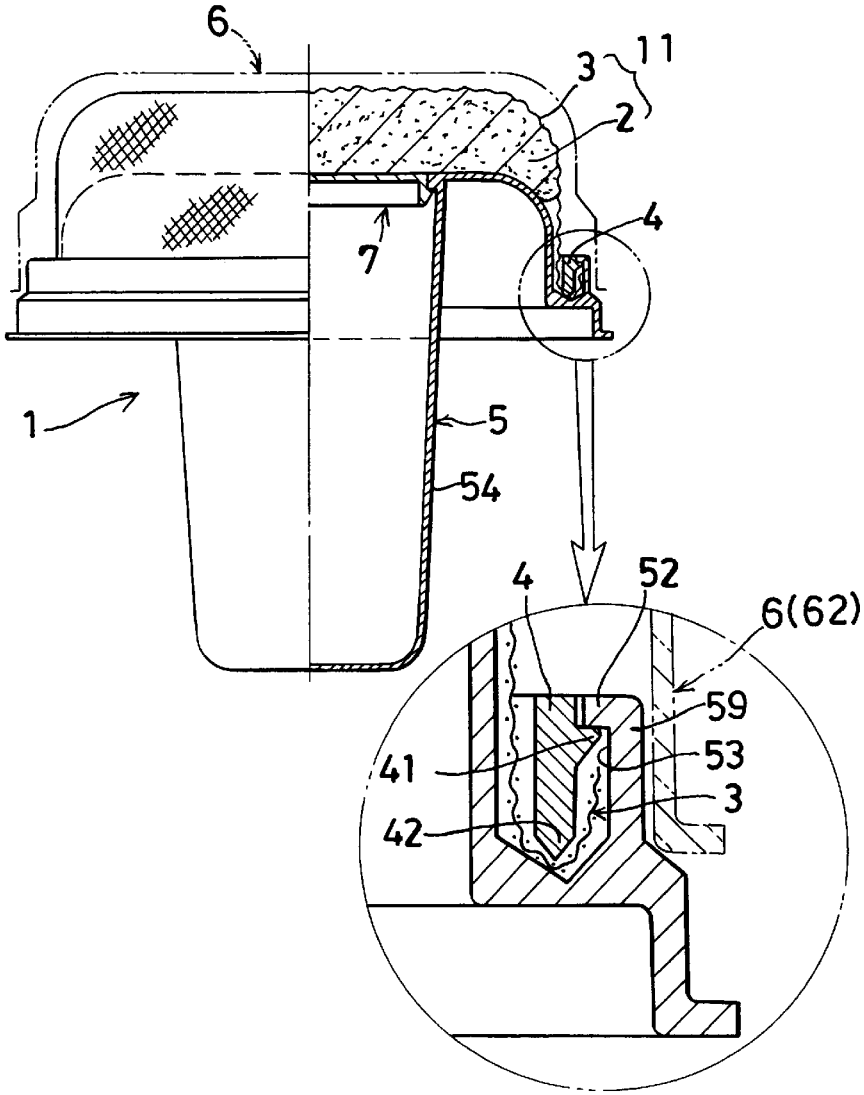
FIG. 3 is a side view showing the surface treating device of FIG. 1, with the right half sectioned.
Figure 4:
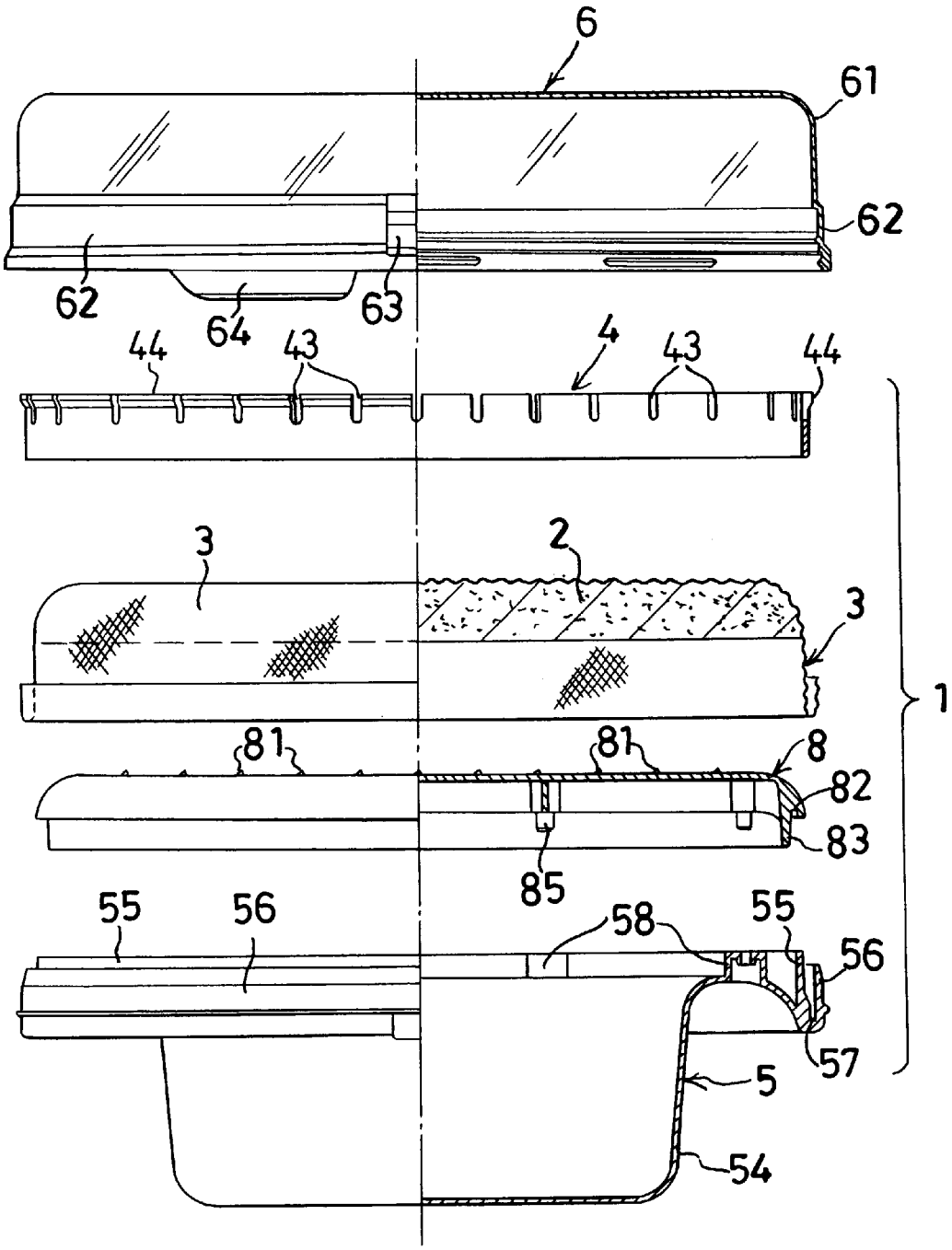
FIG. 4 is an exploded front view showing a second embodiment of the surface treating device according to the present invention, with the right half thereof sectioned.
Figure 5:
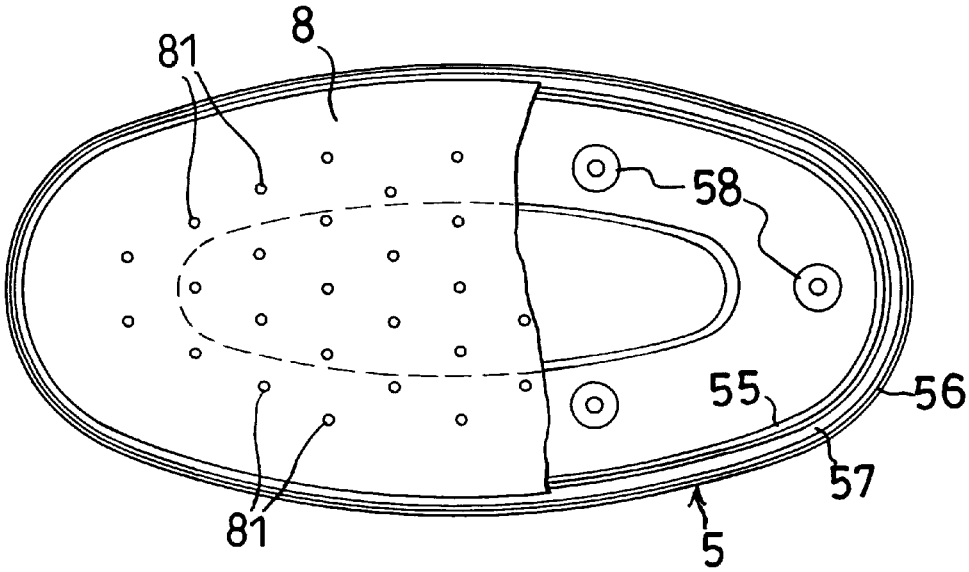
FIG. 5 is a plan view showing the surface treating device of FIG. 4, with a base member fitted on the open end on a grip portion.
Figure 6:
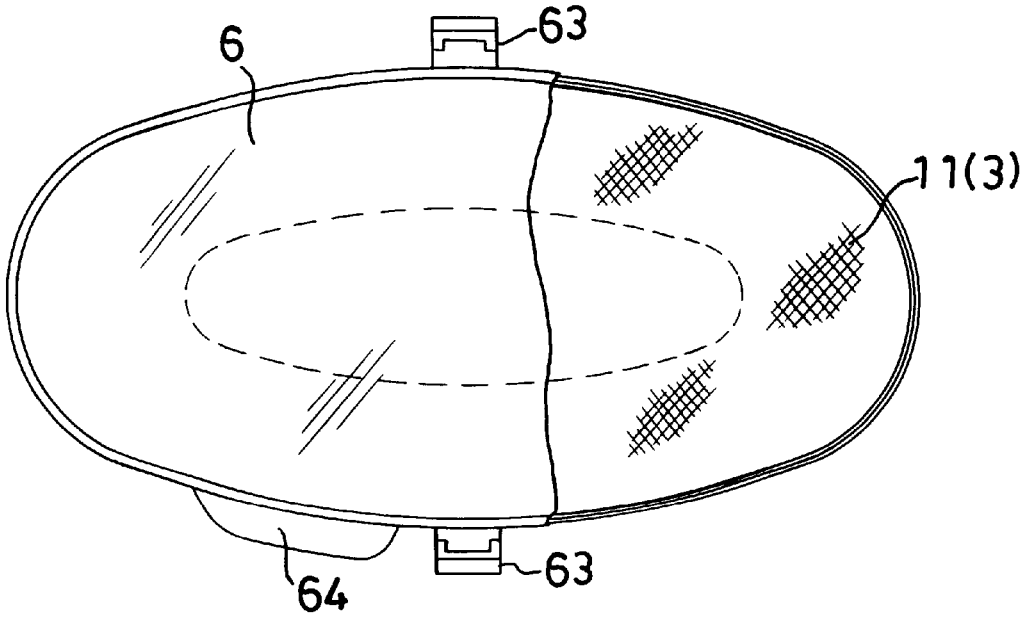
FIG. 6 is a partially cutaway plan view showing the surface treating device of FIG. 4.

FIGS. 1 to 3 illustrate a first embodiment of the surface treating device 1 according to the present invention, The device 1 is a wet-type one usable advantageously as an applicator for applying a lustering agent to car bodies and comprises a material constituting a treating portion 11 of a continuously foamed soft body (sponge) 2 of urethane etc. and a fibrous film 3 coated on the surface of the body 2. The continuously foamed body occludes therein a lustering agent such as semisolid wax or like agent. [A surface treating device having a treating portion impregnated with wax, detergent or the like agent is called a wet-type one, and one having a treating portion impregnated with no such agent is called a dry-type one throughout the description.]

The surface treating device (lustering-agent applicator) 1 fundamentally comprises the material (2 and 3), an annular engaging member 4 and a holder 5. Since the continuously foamed body 2 occludes a lustering agent therein, as described above, the material is provided with a cover member 6 for covering the material to prevent accidental adherence of wax before the use of the device and volatilization of the lustering agent, such as wax, detergent, etc., occluded in the body 2.

Each of the component members will be described hereinafter.

The material constituting the treating portion 11 coming in contact with a surface to be treated (a car body surface in this case) when using the surface treating device 1, comprises the continuously foamed body 2 and the fibrous film 3 coated on the surface of the body 2. The continuously foamed body 2 is impregnated with nothing when applied to a dry-type surface treating device, but is impregnated with (occludes therein) a lustering agent, detergent or other such agent when applied to a wet-type surface treating device.

In this embodiment, the continuously foamed body 2 is sponge as described above, i.e., a molded soft body having continous pores therein. The continuous pores form spaces for occluding a lustering agent, etc. when the body 2 is applied to a wet-type surface treating device. The lustering agent, detergent or other such agent includes wax, a polisher and a cleaner in the state of liquid, solid or emulsion. A solid agent is first melted into liquid and the liquid is occluded in the body 2. In this embodiment, semisolid wax at normal room temperature is melted at 70° C., and the melt is impregnated in the body 2 so that it is occluded therein.

Cloth, nonwoven fabric or other such fibrous member that permits permeation of the lustering agent etc. occluded in the continuously foamed body 2 can be used as the fibrous film 3. However, the fibrous film 3 preferably has high resistance particularly to friction and tensile strength. In the present embodiment, cheesecloth (extremely thin, coarse cotton/hemp cloth) is used as the fibrous film 3. Various kinds of cheesecloth, such as of acryl/polyester, acryl/rayon, etc. having various characteristics, are available on the market. A suitable one can be selected from among the various kinds.

The annular engaging member 4 is a member for forcing the end of the material (2, 3) into an annular groove 53 (that will be described later) of the holder 5 and fixing it integrally to the holder 5. The part to be forced into the annular groove 53 may be the end of the fibrous film 3 only. The annular engaging member 4 has a shape formed by molding plural strips of thin plates annularly, although the shape is actually determined by the shape and size of the annular groove 53, that will be described later. To be specific, the annular engaging member 4 is formed to have a shape and a size that can prevent the material (fibrous film 3) from coming out of the annular groove 53. Further, the material of which the annular engaging member 4 is made is not limited, but is plastic in this embodiment.

The annular engaging member 4 has an elliptical shape and is provided on the outside circumferential surface thereof with an engaging portion 41 projecting outward and on the bottom surface thereof with a plurality of engaging projections 42 that are formed in the shape of a conical or pyramidal sharp splinter and substantially equidistantly arranged. The engaging projections 42 bite into the fibrous film 3 to prevent the fibrous film 3 from coming out of the annular groove 53 and may therefore be formed in a saw-toothed shape. Since the annular engaging member 4 is molded to have a shape and a size that can prevent the material (fibrous film 3) from coming out of the annular groove 53, as described above, it does not always require provision of such engaging projections 42. However, the annular engaging member 4, if provided with the engaging projections 42, can prevent the fibrous film 3 from coming out of the annular groove 53 even when it is made thinner. For these reasons, it is preferable for the annular engaging member 4 to have the aforementioned shape and size and the engaging projections 42 so as to make the fibrous film 3 more difficult to come out of the annular groove 53.

The holder 5 has a base 51 for supporting the material (treating portion 11) thereon, the annular groove 53 provided in the inside peripheral surface thereof with an engaging structure, and a hollow cylindrical portion (grip portion 54) to be gripped by a user conducting a lustering work. While it is an integral molding of plastic in this embodiment, the material is not limited to plastic.

In this embodiment, the base 51 of the holder 5 is formed to be flat by fitting a lid member 7 for the base 51 in an open end of the hollow cylindrical grip portion 54 and the annular groove 53 is formed by bending an outer peripheral edge 59 of the base 51 inward. The engaging structure formed in the inside peripheral surface of the annular groove 53 is a convex portion 52 formed on the upper end of the annular groove 53 so as to project inward as is best shown in an inset of FIG. 3 that shows the corresponding part of FIG. 3 in an enlarged fashion. The annular engaging member 4 is attached to the holder 5 by engagement between the convex portion 52 and the engaging portion 41 formed on the outer circumferance of the annular engaging member 4 so as to project outward.

Similarly, the lid member 7 for the base 51 is attached to the holder 5 by engagement between a convex part 51' formed on the open end of the grip portion 54 of the holder 5 so as to project inward and an engaging part 71 formed on the outer circumference of the lid member 7 so as to project outward.

The cover member 6 comprises a bulged portion 61 and a fitting portion 62 and is an integral molding of transparent plastic. The bulged portion 61 covers the treating portion 11 containing a lustering agent to prevent accidental adherence of wax before the use of the device and volatilization of the lustering agent. The fitting portion 62 has an inside diameter slightly smaller than the outside diameter of the outer peripheral edge 59 of the base 51 of the holder 5 surrounding the annular groove 53. The cover member 6 is retained on the holder 5 by pressure-inserting and fitting the fitting portion 62 onto the outer peripheral edge 59.

The surface treating device 1 is fabricated by assembling together the material (2, 3) constituting the treating portion 11, annular engaging portion 4, holder 5 and cover member 6, each having a simple structure. This assemblage is conducted very easily.

To be specific, the treating portion 11 can be supported on the base 51 and fixed integrally to the holder 5 by causing the distal end of the annular engaging member 4 to force the end of at least the fibrous film 3 of the material into the annular groove 53 of the holder 5 and fitting the annular engaging member 4 in the annular groove 53. The end (folded-back part) of the material (at least the fibrous film 3) forced into the annular groove 53 is in a small gap in a state clamped between the side wall surface of the holder 5 surrounding the annular groove 53 and the annular engaging member 4. In addition, the distal ends (engaging projections 42) of the annular engaging member 4 bite into the material (at least the fibrous film 3), Thus, the material is prevented from coming out of the annular groove 53.

The fitting portion 62 of the cover member 6 is then fitted on the outer peripheral edge 59 of the base 51 surrounding the annular groove 53 of the holder 5. Since the inside diameter of the fitting portion 62 is 0.1 to 0.4 mm smaller than the outside diameter of the outer peripheral edge 59, pressure insertion of the fitting portion 62 onto the outer peripheral edge 59 elastically deforms the cover member 6 and the holder 5 and the two are closely fitted to each other by the spread and restoration of the material of the cover member 6. This close fitting produces surface pressure on the contact surfaces to suppress volatilization loss of the volatile component in a lustering agent etc. and ensure a long service life of the device.

When the surface treating device 1 thus assembled is not in use, accidental adherence of wax occluded in the treating portion 11 can be prevented by the cover member 6. In operation, by removing the cover member, grasping the grip portion 54 of the holder 5 and bringing the treating portion 11 against an automobile body, the treating portion 11 is sandwiched between the car body and the base 51. The lustering agent occluded in the treating portion 11 consequently oozes out and is applied thinly onto the car body surface.

A layer of natural or synthetic macromolecular particles having a thickness of approximately 0.5 to 2 mm, though not shown, can be interposed between the continuously foamed body 2 and the fibrous film 3 when fabricating the treating portion 11, This layer of particles is required to have flexibility and elasticity to such an extent as not to mar the surface to be treated, and is also required not to react with the lustering agent, not to manifest a viscous property relative to the surface, and to exhibit a some degree of motion freedom between the particles and between the fibrous film and the particles. Examples of usable particles includes micelles of protein, such as leather, synthetic leather and β-starch; and powders of less viscous rubber, polytetrafluoroethylene, soft synthetic resin, etc., having a particle diameter approximately in the range of 5 to 500 $\mu$m.

In this embodiment, since wax semisolid at normal room temperature is used as the lustering agent, it does not flow out. However, since wax contains a volatile component, it is necessary to prevent volatilization of the volatile component. If a liquid lustering agent is used, it is necessary to prevent the outflow thereof. In this embodiment, since the fitting portion 62 of the cover member 6 is brought into intimate contact with and airtightly fitted on the outer peripheral edge 59 of the holder 5 surrounding the annular groove 53, the aforementioned volatilization and outflow can be prevented.

FIGS. 4 to 7 illustrate the second embodiment of the surface treating device according to the present invention. The elements identical with or similar to those in the first embodiment are given the same reference numerals and omitted from the description.

While the surface treating device in the first embodiment has the base 51 fitted integrally to the open end of the grip portion 54, the surface treating device in the second embodiment has a base member 8 that is a separate molding from the grip portion 54 and is fitted to the open end of the grip portion 54 to form a base for supporting the treating portion 11 thereon.

Returning to the figures, the base member 8 is provided on the flat surface thereof with a multiplicity of small protuberances 81 that are arranged substantially equidistantly and bite into the continuously foamed body 2 when supporting the treating portion 11 thereon, thereby preventing the foamed body 2 from being displaced. The base member 8 is provided on the peripheral edge thereof with an overhanging portion 82 projecting outward and downward, inward of the overhanging portion 82 with a ring wall portion 83 while leaving a first ring groove 84 between the overhanging portion 82 and the ring wall portion 83, and on the inside surface thereof with a plurality of small cylindrical pole portions 85 that are arranged at predetermined intervals. The base member 8 is made of plastic similarly to the holder 5.

The holder 5 is provided on the open end face of the hollow cylindrical grip portion 54 thereof with the same number of protuberances 58 as the small cylindrical pole portions 85 of the base member 8 at positions corresponding to the positions of the small cylindrical pole portions 85. Each protuberance 58 has a center hole for admitting the corresponding small cylindrical pole portion 85 and positioning the base member 8. As is best shown in an inset in FIG. 7, the holder 5 is further provided on the open peripheral edge thereof with a pair of parallel ring walls 55 and 56 between which a second ring groove 57 is interposed for fitting the annular engaging member 4 therein.

The cover member 6 is provided on opposite side surfaces thereof with a pair of engagement portions 63 and on one side surface thereof with a projecting portion 64.

Assemblage of these component members into the surface treating device 1 of the second embodiment will be described hereinafter.

The base member 8 is disposed to face the open end face of the holder 5. The inside ring wall 55 of the holder 5 is fitted in the first ring groove 84 of the base member 8 and at the same time the small cylindrical pole portions 85 of the base member 8 are inserted into the corresponding holes formed in the protuberances 58 of the holder 5. As a result, the base member 8 is positioned on the open end face of the holder 5 and fixed thereto so as to cover the holder 5. In this state, the overhanging portion 82 projecting downward at a position above the second ring groove 57 in which the annular engaging member 4 is fitted, constitutes an engagement structure for the annular engaging member 4.

The treating portion 11 is fixed to the holder 5 in the same manner as in the first embodiment. To be specific, the treating portion 11 can be supported on the base member 8 and fixed integrally to the holder 5 by causing the distal end of the annular engaging member 4 to force the end of at least the fibrous film 3 into the second ring groove 57 and fitting the annular engaging member 4 in the second ring groove 57. The annular engaging member 4 momentarily enlarges in diameter owing to the presence of a plurality of cuts 43 formed therein as it passes over the overhanging portion 82 of the base member 8 and, upon having passed over the overhanging portion 82 and being fitted in the second ring groove 57, restores to its original diameter.

Figure 7:
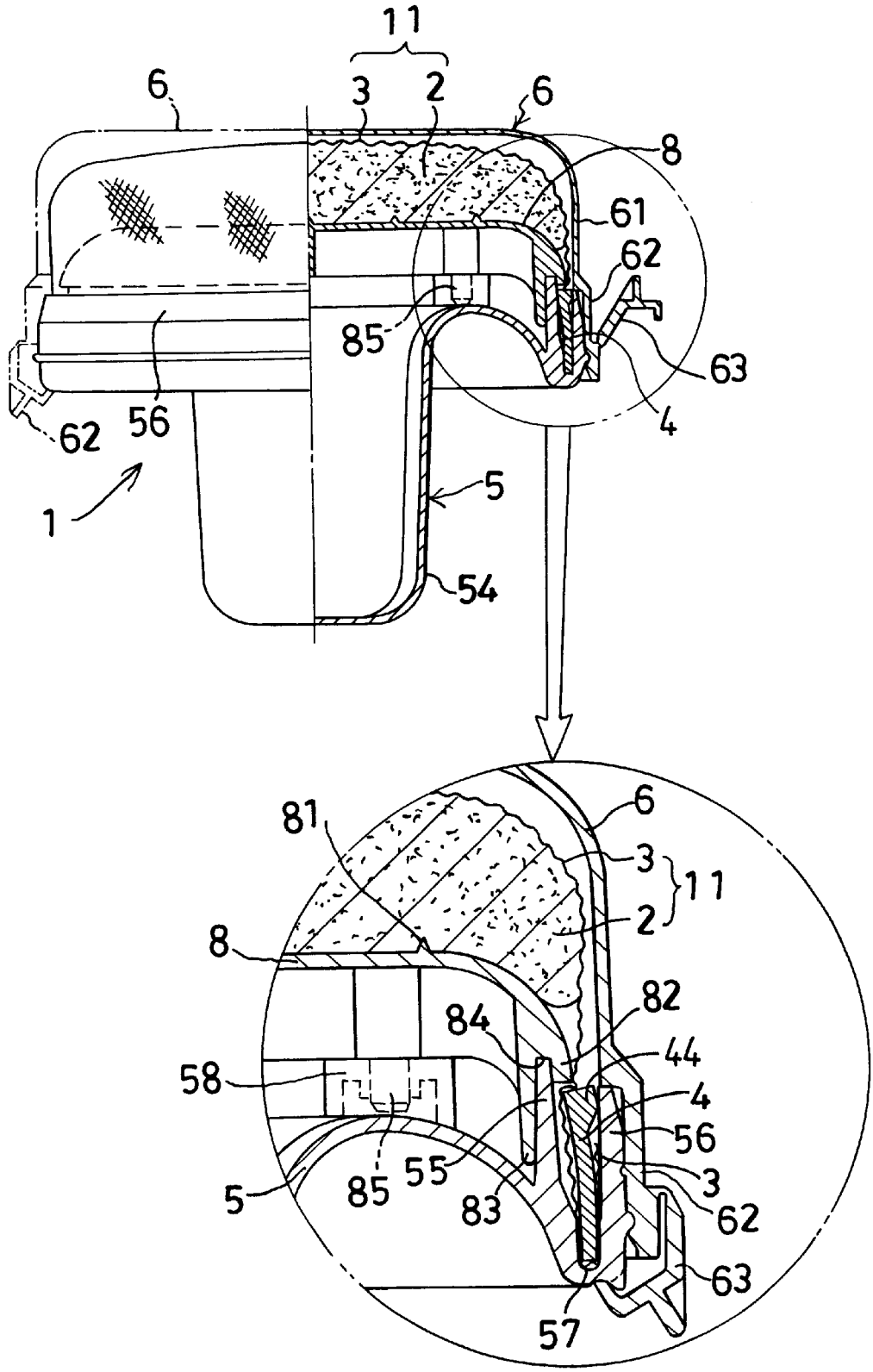
FIG. 7 is a side view showing the surface treating device of FIG. 4, with the right half sectioned.

As is best shown in the inset in FIG. 7, since the end of the fibrous film 3 forced into the second ring groove 57 is clamped between the side wall of the second ring groove 57 and the annular engaging member 4 and since a swollen portion 44 at the upper outer periphery of the annular engaging member 4 abuts against the inner surface of the outside ring wall 56 and is bent inward to cause the bent end to abut on the downward projecting overhanging portion 82, the fibrous film 3 is prevented from coming out of the second ring groove 57.

Thus, in the surface treating device according to the second embodiment the engagement structure can be easily formed by the annular engaging member 4 at a position above the second ring groove 57 by fitting the separate base member 8 on the open end face of the holder 5.

The cover member 6 can be airtightly attached to the holder 5 in the same manner as in the first embodiment by pressure-inserting and fitting the fitting portion 62 of the cover member 6 onto the outer periphery of the outside ring wall 56 surrounding the second ring groove 57 of the holder 5.

Further, when the airtight attachment of the cover member 6 to the holder 5 is retained for a long period of time, there is a possibility of the cover member 6 being spontaneously detached from the holder 5 due to an increase in internal pressure (air pressure and vapor pressure) caused by changes in the surrounding temperature and atmospheric pressure etc.

To avoid this spontaneous detachment, the cover member 6 of the present embodiment is provided on opposite side surfaces with the engagement portions 63. When the cover member 6 is pressure-inserted and fitted onto the holder 5, a concave portion on the inner peripheral surface of the fitting portion 62 is fitted on the outside ring wall 56 as shown in the inset in FIG. 7. In this state, by rotating the engagement portions 63 to cause the distal end thereof to engage with the holder 5, the cover member 6 can be firmly fixed to the holder 5. When the internal pressure in the holder 5 rises, the cover member 6 is expansion-deformed in the outer peripheral direction by the pressure to leave a gap between itself and the outside surface of the holder 5, from which the inside air and the volatile component of wax etc. are discharged. However, this can be prevented because the cover member 6 is retained in the firmly fixed state as described above.

The firmly fixed cover member 6 can be easily detached from the holder 5 when using the device by disengaging the pair of engagement portions 63 of the cover member 6 from the holder 5 and rotating the grip portion 54 while grasping the grip portion 54 of the holder 5 using one hand and holding the projecting portion 64 using the other hand.

Although the present invention has been described and illustrated in detail with reference to the two embodiments, it is to be clearly understood that the same is intended by way of illustration and example only and is not to be taken by way of limitation. Therefore, the spirit and scope of the present invention are to be limited only by terms of the appended claims and equivalents thereto. Although the lustering agent applicator has been illustrated as a wet-type surface treating device, other wet-type surface treating devices such as a water-drop adherence preventing device for automobile windshields, a cleaning (cleansing) device, an eraser for blackboards, a broad marker pen (for signboards), etc. can be realized by changing the kind of the material of the treating portion and changing the kind of liquid occluded in the material. As a dry-type surface treating device, an eraser for blackboards can be cited.

As has been described in the foregoing, the surface treating device according to the present invention comprises a material constituting a treating portion, an annular engaging member and a holder equipped with a base portion, the structures of which are very simple, resulting in high productivity. In assembling these component members, adhesive agent, welding operation and other such means or operation that have heretofore been adopted are not required. Therefore, no special apparatus or equipment is required, resulting in safety for operators and high practical utility.

Furthermore, the wet-type surface treating devices having a lustering agent, detergent, or other such agent occluded in their treating portion can be advantageously used as disposable ones.

Although the handy brush and blackboard eraser have been illustrated as dry-type surface treating devices, other dry-type surface treating devices such as a squeegee for windows, etc. can be realized by changing the material to hard rubber or the like.

The surface treating device according to the present invention can be used as a lustering-agent applicator for car bodies and tires, furniture, etc., a cleaner, a blackboard eraser, etc. Thus it has a variety of applications.

What is claimed is:

1. A surface treating device comprising:

a material that constitutes a treating portion of a continuously foamed body coated with a fibrous film;

a holder that has a base for supporting the treating portion thereon and an annular groove provided in an inside peripheral surface thereof with an engaging structure; and an annular engaging member that has a distal end forcibly fitting an end of the treating portion into the annular groove of the holder to support the treating portion on and fix it integrally to the base.

2. The surface treating device according to claim 1, wherein said continuously foamed body is impregnated with a lustering agent or detergent.

3. The surface treating device according to claim 1, further comprising a cover member having a bulged portion for covering said treating portion.

4. The surface treating device according to claim 3, wherein said cover member is provided on opposite side surfaces thereof with a pair of engagement portions and on one side surface thereof with a projecting portion.

5. A surface treating device comprising:

a material that constitutes a treating portion of a continuously foamed body coated with a fibrous film;

a holder comprising:

a hollow cylindrical grip portion that has an open end face provided with an annular groove having an engaging structure in an inside peripheral surface of the annular groove; and a base member that supports the treating portion thereon and has a peripheral edge fitted on the open end face of the grip portion and provided with an overhanging portion projecting downwardly; and an annular engaging member that has a distal end forcibly fitting an end of the treating portion into the annular groove of the grip portion to support the treating portion on and fix it integrally to the base member of the holder.

* * * * *